US010562592B2

(12) United States Patent
Minor

(10) Patent No.: US 10,562,592 B2
(45) Date of Patent: Feb. 18, 2020

(54) UNDERWATER WINGS FOR PROVIDING LIFT TO BOATS

(71) Applicant: Jason Bernard Minor, Southlake, TX (US)

(72) Inventor: Jason Bernard Minor, Southlake, TX (US)

( * ) Notice: Subject to any disclaimer, the term of this patent is extended or adjusted under 35 U.S.C. 154(b) by 20 days.

(21) Appl. No.: 15/957,508

(22) Filed: Apr. 19, 2018

(65) Prior Publication Data

US 2018/0304968 A1 Oct. 25, 2018

Related U.S. Application Data

(60) Provisional application No. 62/488,709, filed on Apr. 22, 2017.

(51) Int. Cl.

| | |
|---|---|
| ***B63B 1/28*** | (2006.01) |
| ***B63B 1/24*** | (2020.01) |
| ***B63B 1/12*** | (2006.01) |

(52) U.S. Cl.

CPC ..... *B63B 1/242* (2013.01); *B63B 1/121* (2013.01); *B63B 1/125* (2013.01); *B63B 1/248* (2013.01); *B63B 1/28* (2013.01); *B63B 1/285* (2013.01); *B63B 2001/128* (2013.01)

(58) Field of Classification Search

CPC ..... B63B 1/242; B63B 1/28; B63B 1/121; B63B 1/125; B63B 1/248; B63B 1/285; B63B 2001/128

See application file for complete search history.

(56) References Cited

U.S. PATENT DOCUMENTS

| | | | | |
|---|---|---|---|---|
| 3,830,178 | A | 8/1974 | Lang | |
| 3,905,011 | A * | 9/1975 | Nichols | B63B 21/22 340/986 |
| 3,988,994 | A | 11/1976 | Nitzki | |
| 4,508,046 | A * | 4/1985 | Coulter | B63B 35/7923 114/274 |
| 4,582,011 | A | 4/1986 | Logan | |
| 4,615,291 | A * | 10/1986 | Jones | B63B 1/242 114/280 |
| 5,295,453 | A | 3/1994 | Inoue | |
| 6,164,235 | A | 12/2000 | Hoppe | |
| 7,908,989 | B2 | 3/2011 | McLoughlin et al. | |
| 8,820,260 | B2 | 9/2014 | Brizzolara | |
| 2005/0263059 | A1 * | 12/2005 | Earl, Jr. | B63B 1/28 114/280 |

(Continued)

FOREIGN PATENT DOCUMENTS

| | | |
|---|---|---|
| CN | 101708767 B | 5/2010 |
| EP | 51073 A1 | 5/1982 |

(Continued)

*Primary Examiner* — Stephen P Avila

(74) *Attorney, Agent, or Firm* — Nelson Bumgardner Albritton P.C.

(57) ABSTRACT

The present invention relates generally to underwater wings for providing lift to boats. More particularly, the invention comprises an underwater wing that attaches to the hull or hulls of a pontoon or tri-toon boat. The purpose of the wing is to provide a designated amount of lift to reduce drag and improve performance of the watercraft. This is different from a traditional hydrofoil, which is designed to lift a boat completely out of the water.

16 Claims, 6 Drawing Sheets

(56) References Cited

U.S. PATENT DOCUMENTS

| | | | | |
|---|---|---|---|---|
| 2012/0325135 | A1* | 12/2012 | Ketterman | B63B 1/242<br>114/39.24 |
| 2015/0291257 | A1 | 10/2015 | Duncan | |
| 2018/0050762 | A1* | 2/2018 | Dombois | B63B 1/286 |

FOREIGN PATENT DOCUMENTS

| | | | |
|---|---|---|---|
| GB | 1524938 | A | 9/1978 |
| RU | 2177425 | C1 | 12/2001 |
| WO | WO201425257 | A1 | 2/2014 |

* cited by examiner

UNDERWATER WINGS FOR PROVIDING LIFT TO BOATS

This application claims priority to U.S. Provisional Application No. 62/488,709, filed on Apr. 22, 2017. The disclosure of the above-cited application is incorporated by reference in its entirety.

FIELD OF THE INVENTION

The present invention relates generally to underwater wings for providing lift to boats. More particularly, the invention comprises a hydrofoil system that attaches to the hull or hulls of a pontoon or tri-toon boat. The system preferably comprises one or more hydrofoils, mounting brackets, and a mechanism for raising and lowering the foils relative to the water, said mechanism ideally being controllable from the helm of the boat.

BACKGROUND OF THE INVENTION

Boating and other water sports are popular outdoor activities that many people enjoy. Boats are generally inefficient because they are heavy and create a lot of drag in the water. While many solutions have been proposed for increasing efficiency for watercraft, including streamlining, reducing weight, and increasing buoyancy, most manufacturers today ignore the true problems of boat weight, drag, and efficiency, and instead attempt to overcome these problems simply by partnering with engine manufacturers who build bigger, more expensive motors to accommodate the performance demands of heavy and inefficient hulls.

One common solution in the industry is the use of hydrofoils to provide lift to the boat. A hydrofoil is basically a lifting surface that acts like a wing in the water, similar to the way an airfoil works to provide lift to aircraft. Traditional hydrofoils are nothing new. But while they have been around for decades, they have generally attempted to solve a different problem than the present invention. Traditional hydrofoils were created to lift military and commercial boats completely out of the water. They have also been used in sailing and watersports industries but have failed to become mainstream because of serious safety issues associated with loss of lift in the wings during flight due to ventilation and issues relating to landing the boat back in the water.

The problems of inefficient, heavy hulls are particularly pronounced in pontoon and tri-toon boats, since they are displacement hulls. Displacement hulls are designed to plow through the water instead of glide above it. These types of boats are generally slower, heavier, and carry larger loads than speedboats and other recreational watercraft, which have planning hulls that are designed to rise up and glide across the water's surface when enough propulsion is provided. Other efforts have been made to provide hydrofoil-type lift for pontoon and tri-toon boats, but these efforts do not provide the advantages and efficiencies of the present invention. For example, many pontoon manufacturers advertise and sell "lifting strakes," which are essentially small protrusions extending from the edges of pontoons to help provide hydrodynamic efficiency. Additionally, another popular design in the art has been the Pontoon Water Glide, which is described in U.S. Pat. No. 6,016,762. However, these products do not provide the design features or the designated lift of the present invention. For example, the product and patent mentioned above does not comprise a wing that extends substantially across the space between two pontoons and instead is designed as an additional displacement hull effectively resembling a third pontoon positioned in the middle of the hull. The present invention overcomes the above and other deficiencies by providing an efficient underwater wing system especially adapted for use in pontoon and tri-toon boats.

SUMMARY OF THE INVENTION

The present invention relates generally to a hydrofoil system for providing lift to boats. More particularly, the invention comprises an adjustable mounting system and underwater wing(s) that attach to the hull or hulls of a pontoon or tri-toon boat. The purpose of the wing system is to provide an adjustable and designated amount of lift to reduce drag and improve performance of the watercraft. This is different from a traditional hydrofoil, which is designed to lift a boat completely out of the water.

It is one object of the present invention to provide a system for providing lift to a watercraft during operation.

It is a further object of the present invention to provide a system that provides a generally designated amount of lift to a watercraft during operation.

It is a further object of the present invention to provide a system that provides a mechanism to adjust the foil depth.

It is a further object of the present invention to provide a system that provides lift to a watercraft without raising the watercraft completely out of the water during operation.

It is a further object of the present invention to provide a system that can be attached to the hull of a pontoon boat.

It is a further object of the present invention to provide a system that can be attached to the hull of a tri-toon boat.

It is a further object of the present invention to provide a system that can be installed on a new or an existing watercraft.

It is a further object of the present invention to provide a system that reduces drag on the water, provides increased efficiency, and allows for smaller engines, less fuel and oil, and reduced maintenance.

It is a further object of the present invention to provide a system that improves speed and performance, stabilizes the ride, and reduces pounding typically caused by waves while boating These objectives are illustrative in nature. Additional advantages and applications for the present invention will be readily apparent to persons skilled in the art upon a review of the invention and the disclosures contained herein.

BRIEF DESCRIPTION OF THE DRAWINGS

The drawings referenced below are included so that the features and advantages of the presently disclosed invention may be better understood. It should be noted, however, that the attached drawings are meant only to be illustrative of particular embodiments of the invention and should not be considered limiting of its scope. The invention itself, as well as a preferred mode of use, further objectives and advantages thereof, will best be understood by reference to the following detailed description of the preferred embodiment when read in conjunction with the attached drawings, which are summarized below.

DETAILED DESCRIPTION OF THE INVENTION

Figure 1:
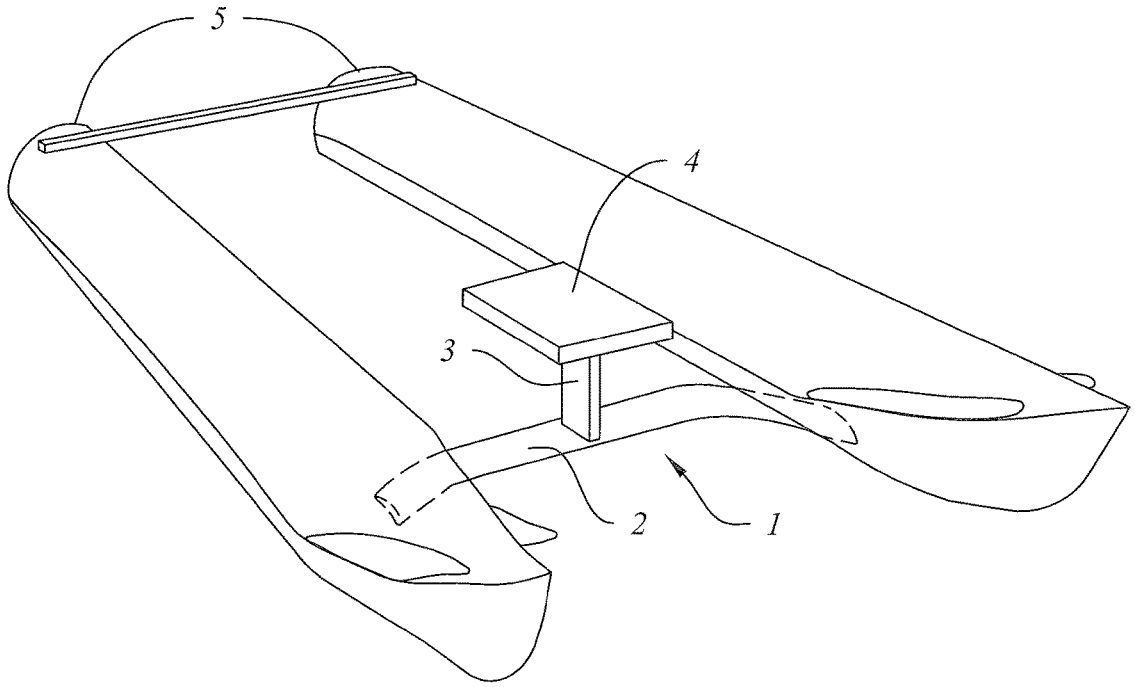
FIG. 1 depicts an isometric view of an exemplary design of a wing structure (with pontoons, for context) in accordance with one embodiment of the present invention.

Presently preferred embodiments of the invention are shown in the above-identified figures and described in detail below. In describing the preferred embodiments, like or identical reference numerals are used to identify common or similar elements. The figures are not necessarily to scale, and certain features and certain views of the figures may be shown exaggerated in scale or in schematic in the interest of clarity and conciseness.

The present invention relates generally to a hydrofoil system for providing lift to boats. More particularly, the invention comprises hydrofoils, brackets, and a mechanism allowing the hydrofoils to be adjusted. The system could be attached to the hull or hulls of a pontoon or tri-toon boat. The invention described herein relates to watercraft with aluminum hulls such as pontoon or tri-toon boats or watercraft with hulls of similar material to which the wing structure may be attached.

In a preferred embodiment of the present invention, a wing structure is attached to the bottom or inside hull of a pontoon or tri-toon boat. The purpose of the wing structure is to provide a designated amount of lift required to reduce drag and improve performance during operation. This approach is different than a typical hydrofoil, which is designed to lift a boat or other watercraft completely out of the water. In the design of the present invention, different wing types, sizes, or shapes may be fitted for different types of watercraft based upon the lift needs. This allows the wing structure of the present invention to deliver the performance metrics desired for each type of watercraft. Major factors that impact the wing design are the watercraft hull design, weight, length, and the horsepower of the engine. By providing a designated amount of lift, the wing structure reduces drag on the water, which in turn improves the performance and speed. This also decreases fuel and oil consumption and reduces stress on the watercraft motor.

The preferred design of the present invention generally comprises three major parts: (1) a wing; (2) one or more mounting brackets; and (3) a mechanism allowing the wing to be adjusted. Preferably, the wing structure, mounting bracket(s), and adjustable mechanism are each made from military-grade aluminum (e.g., 5083-H116 or 5086-H116), though other materials are also contemplated, such as fiberglass, carbon fiber, titanium, or other materials. A single, molded piece of high-strength aluminum is a preferred material at least for pontoon and tri-toon boats, because it may easily be welded or fastened to the hulls using structural adhesives such as methylmethacrylate. Additionally, the system of the present invention should be able to withstand intense pressure from water forces—such as 1,500 lbs. or more of pressure. The wings of the present invention should ideally also be thinner than one may expect—for example, in the order of 1 inch thick for a 24-foot pontoon boat where the wing span is 48 inches and the cord length is 12 inches. Thus, the wing should be as thin as possible while still having the strength necessary to carry the heavily load of the watercraft. The composition and internal design of the wing is an important consideration. For example, the appropriate foil for a given boat will take into consideration the size and weight of the boat itself and the expected passenger load. If the wing is too big, the boat may fly out of the water. If it is too small, the wing will not deliver the speed and performance goals. Additionally, the internal structure of the wing must be strong enough to support the weight of the boat at desired speeds. Accordingly, the foil itself may comprise internal ribs and braces (rather than being solid) to provide structural strength while minimizing the weight of the foil itself—much like an aircraft wing.

The wing size will be determined by the amount of lift needed. For example, an 18-foot pontoon boat would have a smaller wing than a 24-foot pontoon boat. The design of the present invention should be relatively low profile to reduce drag. Preferably, the angle of attack is between −2 and +2 degrees.

The shape of the wing itself is also an important factor. In various embodiments of the present invention, the wing is a surface piercing hydrofoil, which are typically "U", "V", "C", "L", or "J"-shaped. Alternately, the wing can be a fully submerged hydrofoil with an inverted "T" shape. Moreover, while various embodiments of the present invention comprise a single wing that is connected either to a stabilizing mast and plate or to two pontoon hulls, alternate embodiments are contemplated as within the scope of the present invention, including embodiments comprising two separate wings, each of which is attached to a separate pontoon hull. Additionally, the wing of the present invention preferably comprises fences positioned along the wing to promote laminar water flow. The fences are a critical component of the ideal wing design since they help reduce ventilation, which causes loss of lift in the wings.

The location where the wing is attached to the hull varies depending on the hull design of the watercraft, the length and weight of the watercraft, and the horsepower of the engine.

FIG. 1 depicts an isometric view of an exemplary design of a wing structure (with pontoons, for context) in accordance with one embodiment of the present invention. This exemplary embodiment of the invention is the portion in FIG. 1 denoted as element 1. This exemplary embodiment comprises wing portion 2, a stabilizing mast 3, and a stabilizing plate 4, all of which are formed as a single system 1. Preferably, the wing structure 1, stabilizing mast 2, and stabilizing plate 3 are each made from military-grade aluminum (e.g., 5083-H116 or 5086-H116), though other materials are also contemplated, such as fiberglass, carbon fiber, titanium, or other materials. The system 1 may be bolted to the hull of a boat (not pictured) at stabilizing plate 4. Pictured in FIG. 1 are pontoons 5, which carry the boat in the water. The wing structure 2 may span a portion of the width between the pontoons (i.e., less than 75 percent of the width), substantially the entire width (i.e., greater than 75 percent), or the entire width. The wing structure 2 may also be connected to the pontoons 5 for additional support and stability.

Figure 2:
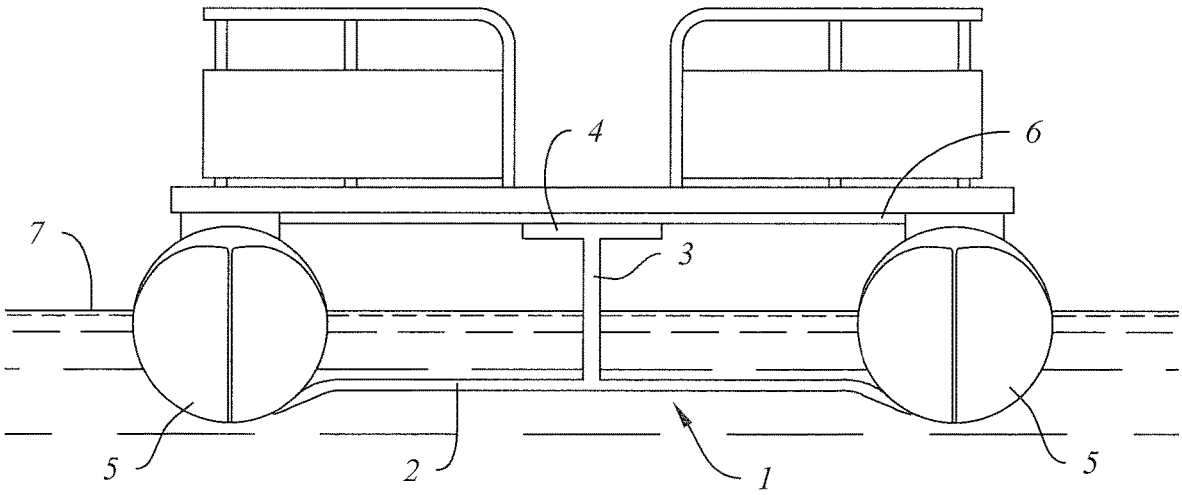
FIG. 2 depicts a front view of an exemplary design of a wing structure attached to a pontoon boat in accordance with one embodiment of the present invention.

FIG. 2 depicts a front view of an exemplary design of a wing structure attached to a pontoon boat in accordance with one embodiment of the present invention. This exemplary embodiment of the invention is the portion in FIG. 2 denoted as element 1. This exemplary embodiment comprises wing portion 2, a stabilizing mast 3, and a stabilizing plate 4, all of which are formed as a single system 1. Preferably, the wing structure 1, stabilizing mast 2, and stabilizing plate 3 are each made from military-grade aluminum (e.g., 5083-H116 or 5086-H116), though other materials are also contemplated, such as fiberglass, carbon fiber, titanium, or other materials. The system 1 is preferably bolted to the hull of a boat 6 at stabilizing plate 4. Pictured in FIG. 2 are pontoons 5, which carry the boat in the water. The waterline appears as element 7 in FIG. 2. The wing structure 2 may also be welded to the pontoons 5 for additional support and stability, as shown.

Figure 3:
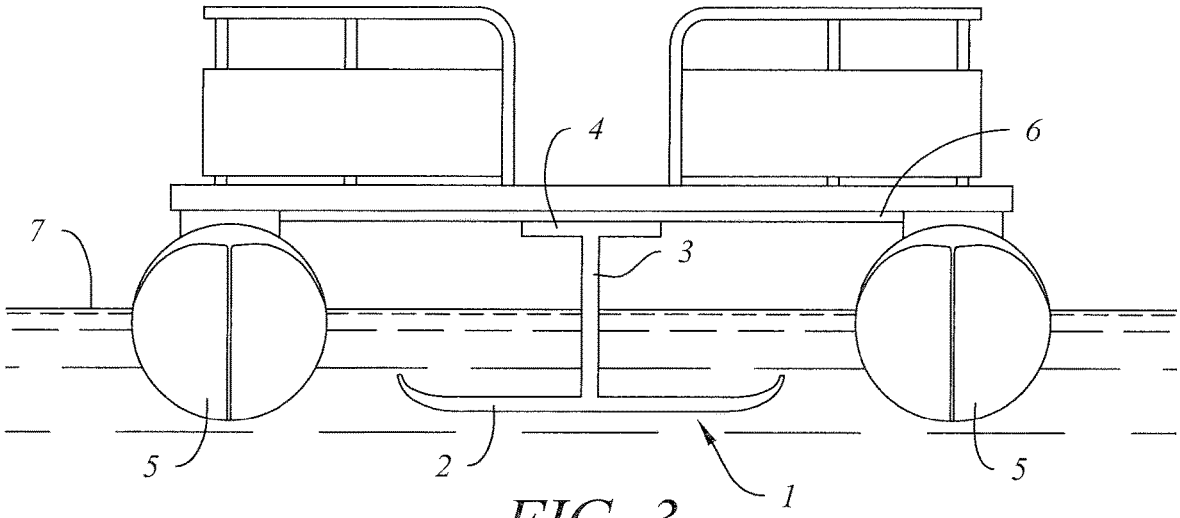
FIG. 3 depicts a front view of another exemplary design of a wing structure attached to a pontoon boat in accordance with another embodiment of the present invention.

FIG. 3 depicts a front view of another exemplary design of a wing structure attached to a pontoon boat in accordance with another embodiment of the present invention. This exemplary embodiment of the invention is the portion in FIG. 3 denoted as element 1. This exemplary embodiment comprises wing portion 2, a stabilizing mast 3, and a stabilizing plate 4, all of which are formed as a single system 1. Preferably, the wing structure 1, stabilizing mast 2, and stabilizing plate 3 are each made from military-grade aluminum (e.g., 5083-H116 or 5086-H116), though other materials are also contemplated, such as fiberglass, carbon fiber, titanium, or other materials. The system 1 is preferably bolted to the hull of a boat 6 at stabilizing plate 4. Pictured in FIG. 3 are pontoons 5, which carry the boat in the water. The waterline appears as element 7 in FIG. 3.

Figure 4:
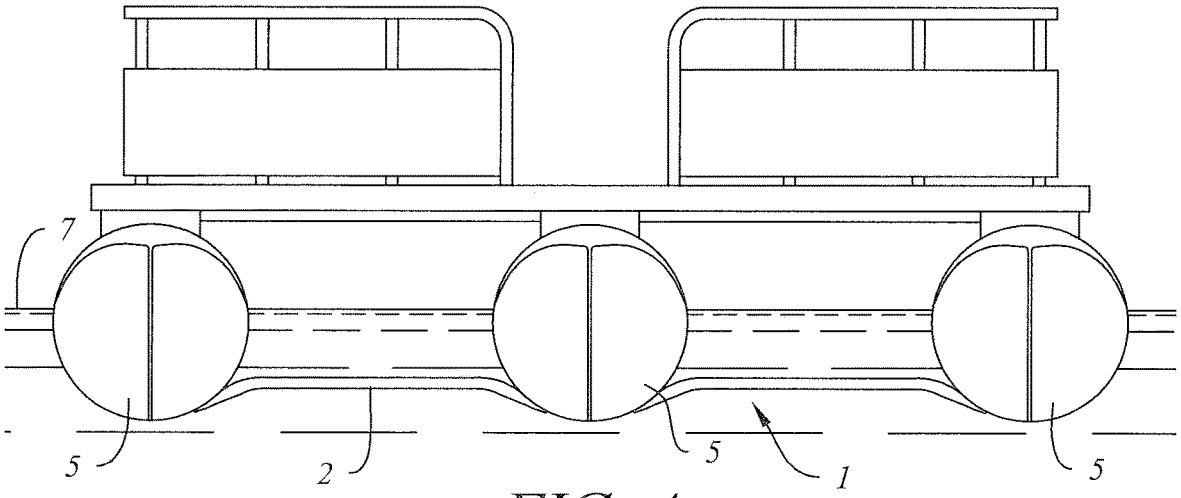
FIG. 4 depicts a front view of an exemplary design of a wing structure attached to a tri-toon boat in accordance with another embodiment of the present invention.

FIG. 4 depicts a front view of an exemplary design of a wing structure attached to a tri-toon boat in accordance with another embodiment of the present invention. This exemplary embodiment of the invention is the portion in FIG. 4 denoted as element 1. This exemplary embodiment comprises wing portion 2 but does not include a stabilizing mast or stabilizing plate, as the middle pontoon 5 serves as the support for the wing in the tri-toon embodiment. Preferably, the wing structure 1 is made from military-grade aluminum (e.g., 5083-H116 or 5086-H116), though other materials are also contemplated, such as fiberglass, carbon fiber, titanium, or other materials. The system 1 is welded to the pontoons 5, as shown. The waterline appears as element 7 in FIG. 4.

Figure 5:
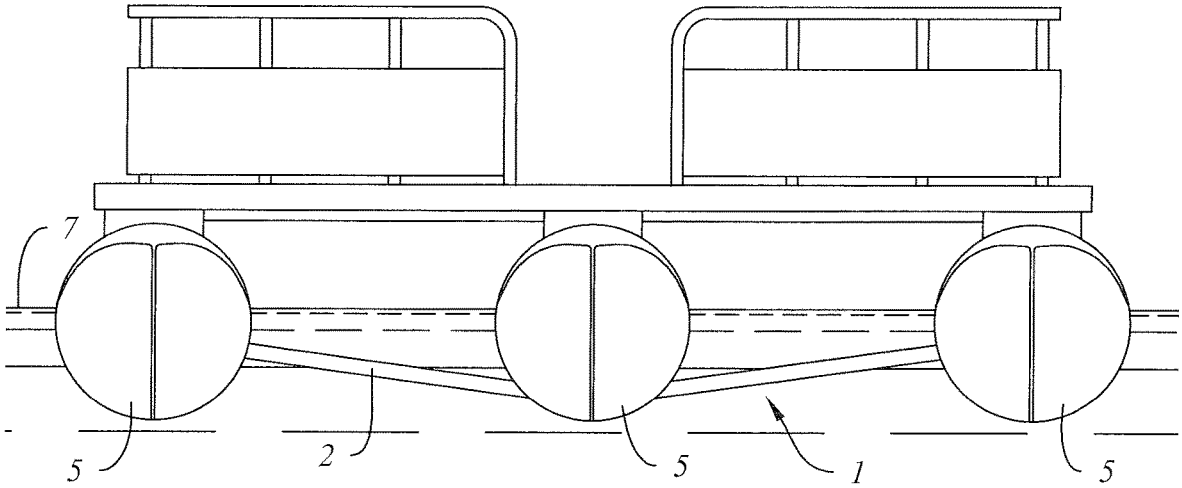
FIG. 5 depicts a front view of another exemplary design of a wing structure attached to a tri-toon boat in accordance with another embodiment of the present invention.

FIG. 5 depicts a front view of another exemplary design of a wing structure attached to a tri-toon boat in accordance with another embodiment of the present invention. This exemplary embodiment of the invention is the portion in FIG. 5 denoted as element 1. This exemplary embodiment comprises wing portion 2 but does not include a stabilizing mast or stabilizing plate, as the middle pontoon 5 serves as the support for the wing in the tri-toon embodiment. Preferably, the wing structure 1 is made from military-grade aluminum (e.g., 5083-H116 or 5086-H116), though other materials are also contemplated, such as fiberglass, carbon fiber, titanium, or other materials. The system 1 is welded to the pontoons 5, as shown. The waterline appears as element 7 in FIG. 4. This embodiment differs from that of FIG. 4 at least because the wing structure 2 has a different shape. As stated above, various wing shapes and designs are contemplated as being within the scope of the present invention. Here, the wing structure 2 attaches at the base of the middle pontoon 5 and near the center of outer pontoons 5, forming more of a V-shaped design.

Figure 6:
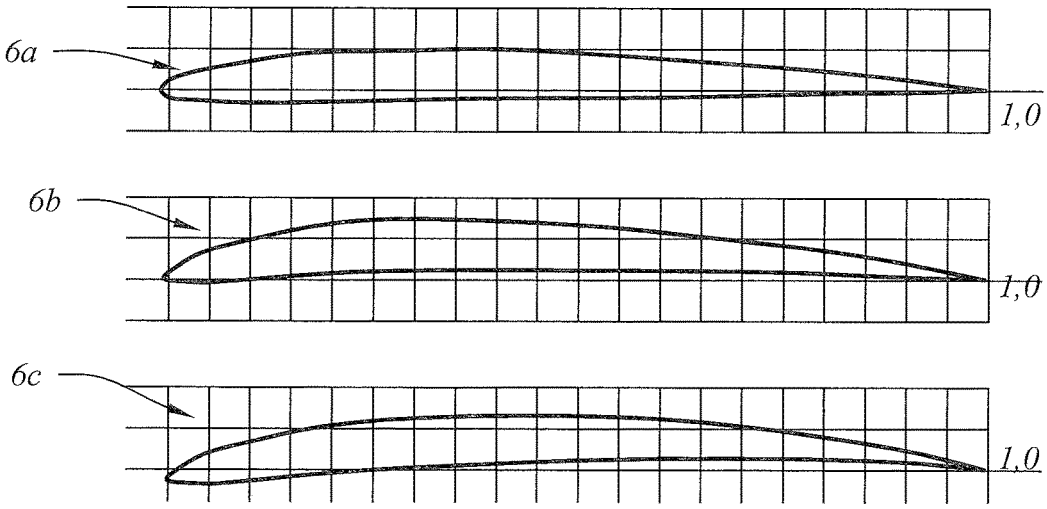
FIG. 6 depicts exemplary wing profiles as tested for use in exemplary embodiments of the present invention. It includes three wing profiles labeled 6*a*, 6*b*, and 6*c*.

FIG. 6 depicts exemplary wing profiles as tested for use in exemplary embodiments of the present invention. Profile 6*a* depicts wing profile NACA (National Advisory Committee for Aeronautics) 2306. Profile 6*b* depicts wing profile NACA 4306. Profile 6*c* depicts wing profile NACA 4506. These wing profiles have been tested with a prototype of the claimed invention and yielded adequate results.

Figure 7:
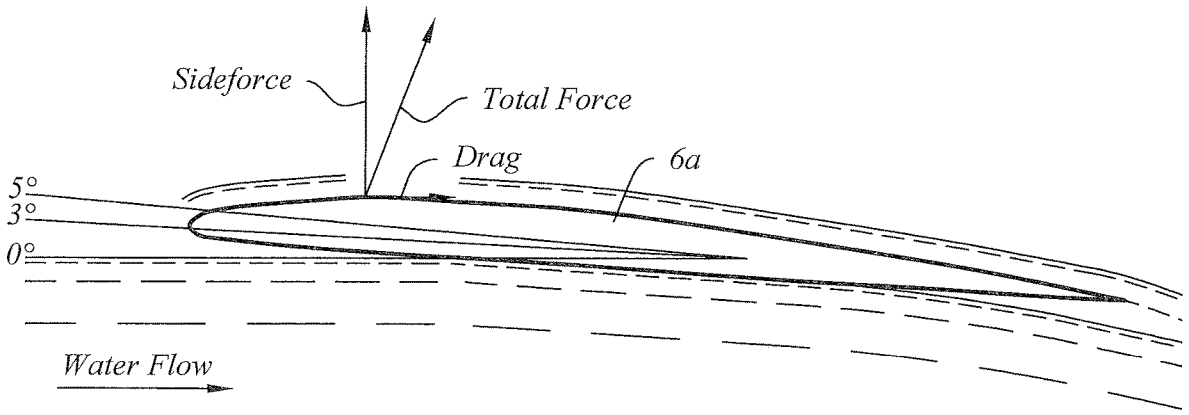
FIG. 7 depicts expected forces applied to the wing profile 6*a*.

FIG. 7 depicts expected forces applied to the wing profile 6*a*. As shown, during ideal operation, the angle of attack for the wing structure is between 3 and 5 degrees.

Figure 8:
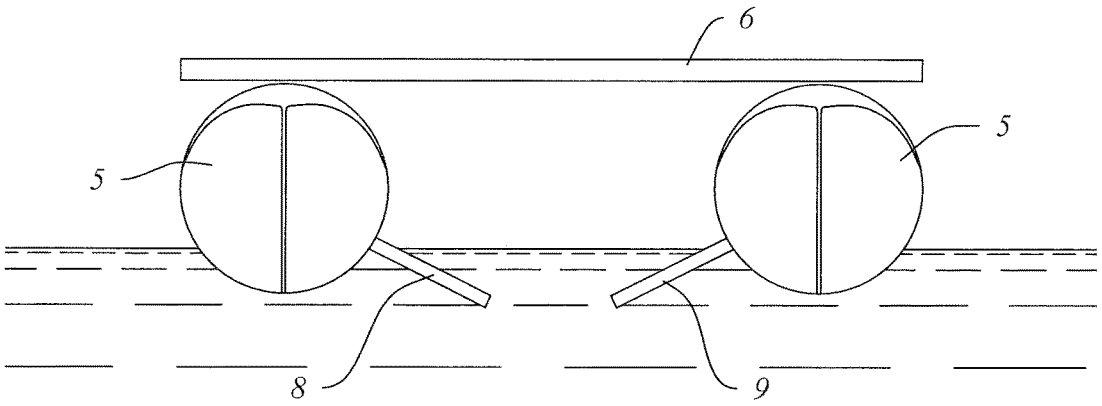
FIG. 8 depicts an alternate embodiment of the present invention comprising two separate wing portions.

FIG. 8 depicts an alternate embodiment of the present invention comprising two separate wing portions. This exemplary embodiment comprises wing portions 8 and 9, which together form a single system. Preferably, the two wing portions 8 and 9 are each made from military-grade aluminum (e.g., 5083-H116 or 5086-H116), though other materials are also contemplated, such as fiberglass, carbon fiber, titanium, or other materials. Wing portions 8 and 9 may be attached to pontoons 5 via bolts, welding, or other suitable connections. Preferably, wings 8 and 9 are attached to brackets (not shown) on pontoons 5. The waterline appears as element 7 in FIG. 8, and the hull of the boat appears as element 6.

Figure 9:
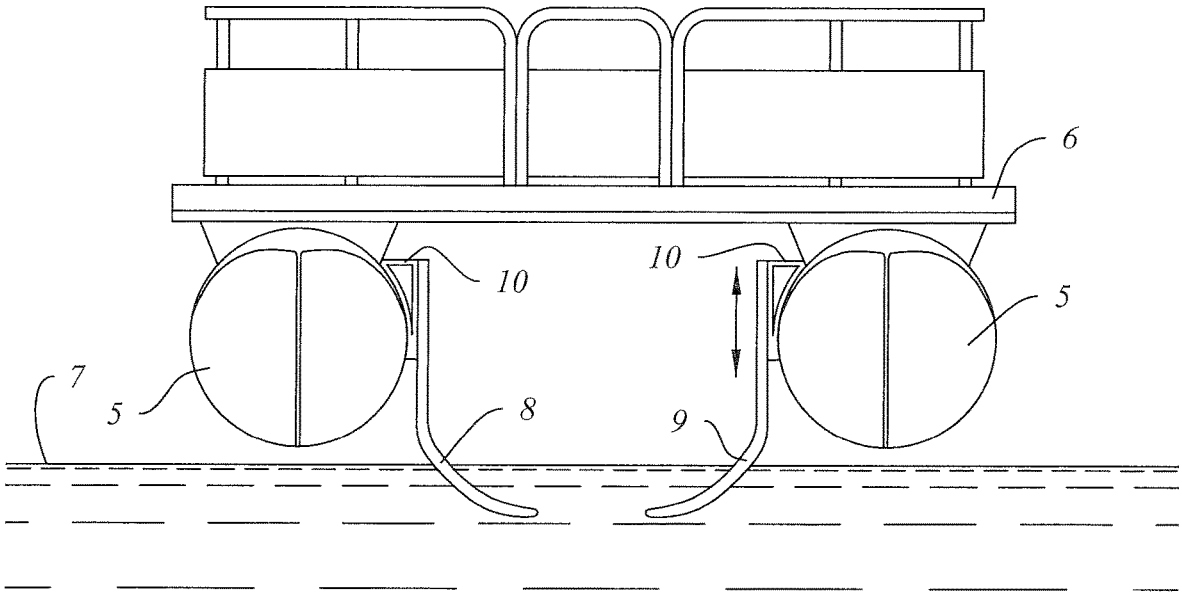
FIG. 9 depicts an alternate embodiment of the present invention comprising two separate curved wing portions in a "J" shape attached to pontoons via hydraulic mounts.

FIG. 9 depicts an alternate embodiment of the present invention comprising two separate curved wing portions in a "J" shape attached to pontoons via hydraulic mounts. This exemplary embodiment of the present invention comprises wing portions 8 and 9, substantially J-shaped, and brackets 10, all of which are formed as a single system. Preferably, the wing portions 8 and 9 are made from military-grade aluminum (e.g., 5083-H116 or 5086-H116), though other materials are also contemplated, such as fiberglass, carbon fiber, titanium, or other materials. Wing portions 8 and 9 are preferably attached to pontoons 5 via mounting brackets 10 placed on the inner sides of pontoons 5. The brackets 10 are preferably bonded to the hulls via methyl methacrylate adhesive (MMA), though they could also be attached via other adhesive or bolted or welded to the pontoons 5. Preferably, the height of the wing relative to the waterline 7 is also adjustable via a strut. For example, the wings 8 and 9 are preferably adapted to slide up and down on the brackets 10 toward or away from hull 6 via electromechanical slides, a hydraulic lift (which may be electromechanically operated), or a manual crank, any of which may be operated from inside the boat. In the preferred embodiment, the wing may be raised or lowered via a hydraulic mount actuated from the helm of the boat. However, other designs are contemplated as being within the scope of the present invention. For example, in alternate embodiments, the wing(s) would pivot or swivel into and out of position. These alternate embodiments may similarly make use of a hydraulic mount, an electromechanical socket, or a manual hinge, any of which may be operated from the helm of the boat or another location inside or outside the boat.

Figure 10:
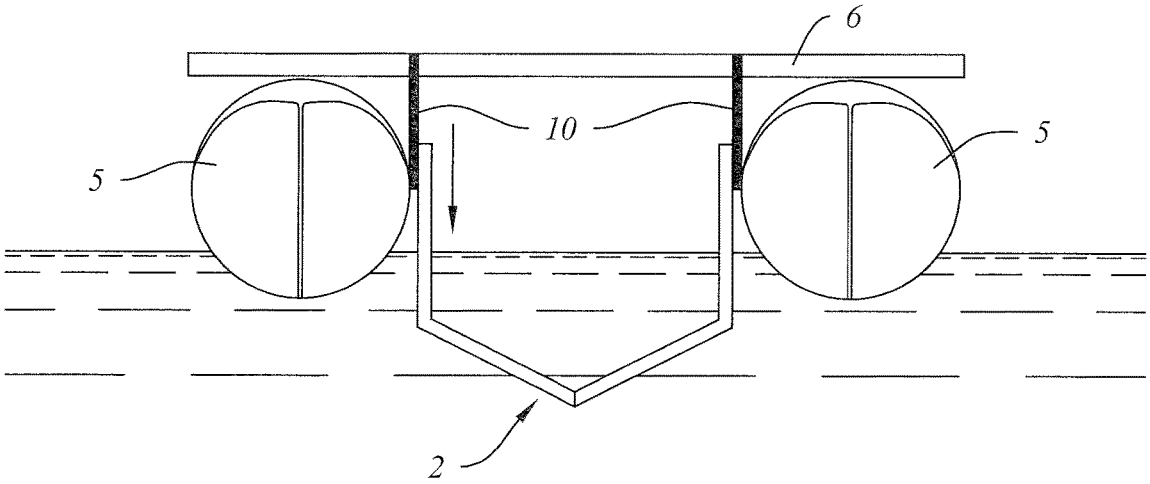
FIG. 10 depicts a front view of another exemplary design of a wing structure attached to brackets on a pontoon boat in accordance with another embodiment of the present invention.

FIG. 10 depicts a front view of another exemplary design of a wing structure attached to brackets on a pontoon boat in accordance with another embodiment of the present invention. This exemplary embodiment of the present invention comprises wing portion 2 and brackets 10, all of which are formed as a single system. Preferably, the wing portion 2 is made from military-grade aluminum (e.g., 5083-H116 or 5086-H116), though other materials are also contemplated, such as fiberglass, carbon fiber, titanium, or other materials. Wing portion 2 is preferably attached to pontoons 5 via mounting brackets 10 placed on the inner sides of pontoons 5. The brackets 10 are preferably bonded to the hulls via methyl methacrylate adhesive (MMA), though they could also be attached via other adhesive or bolted or welded to the pontoons 5. Preferably, the height of the wing relative to the waterline 7 is also adjustable via a strut. For example, the wings are preferably adapted to slide up and down on the brackets 10 toward or away from hull 6 via electromechanical slides, a hydraulic lift, or a manual crank, any of which may be operated from inside the boat.

Figure 11:
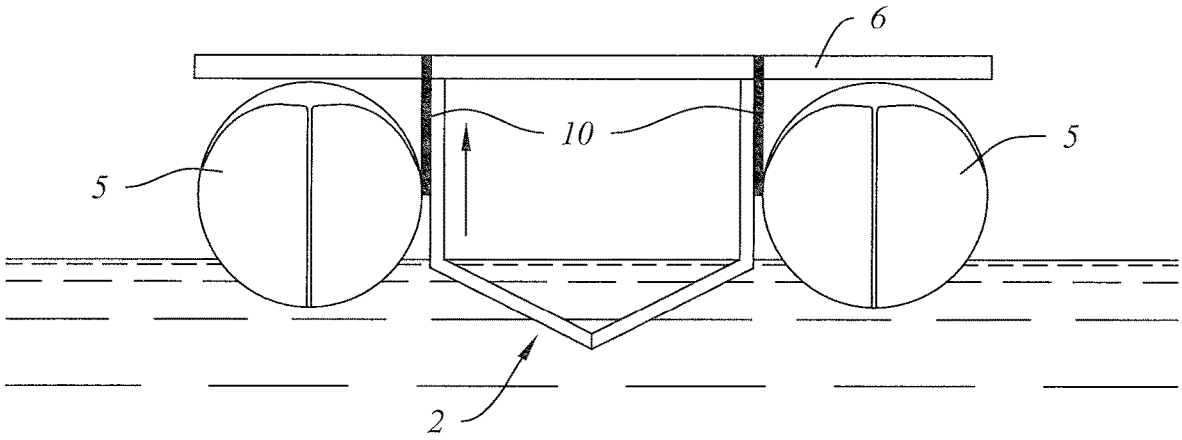
FIG. 11 depicts the embodiment of FIG. 10 with the wing portion in a raised position along the brackets.

FIG. 11 depicts the embodiment of FIG. 10 with the wing portion in a raised position relative to the waterline 7 along the brackets 10.

Although the invention has been described with reference to one or more particular embodiments, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the scope of the invention.

The invention claimed is:

1. A hydrofoil wing system for a pontoon boat comprising:

a wing comprising a length and a width;

a stabilizing mast having a vertical structure with a lower end and an upper end, said lower end attached to a center portion of said wing;

a stabilizing plate attached to said upper end of said stabilizing mast for connecting said wing via said stabilizing mast to a hull of said pontoon boat; and wherein said pontoon boat is a pontoon boat having two pontoon hulls spaced apart by a width, and wherein said width of the wing spans at least seventy-five percent of said width between the pontoon hulls.

2. The hydrofoil wing system of claim 1, wherein said width of the wing spans the entire width between said pontoon hulls.

3. A hydrofoil wing system for a pontoon boat comprising:

a wing comprising a length and a width, said width having a left terminal end and a right terminal end;

a first bracket positioned at said left terminal end for securing said wing to a first pontoon of said pontoon boat; and a second bracket positioned at said right terminal end for securing said wing to a second pontoon of said pontoon boat; and wherein said left terminal end of said wing is configured to slide vertically along said first bracket and said right terminal end of said wing is configured to slide vertically along said second bracket.

4. The hydrofoil wing system of claim 3, wherein said wing further comprises at least one fence arranged parallel to the length of said wing.

5. The hydrofoil wing system of claim 3, wherein said wing is constructed of aluminum.

6. The hydrofoil wing system of claim 3, wherein said wing is constructed of fiberglass.

7. The hydrofoil wing of claim 3, wherein said wing is constructed of carbon fiber.

8. The hydrofoil wing system of claim 3, further comprising a hydraulic lift configured to raise and lower said wing.

9. The hydrofoil wing system of claim 3, further comprising an electromechanical lift configured to raise and lower said wing.

10. A hydrofoil wing system for a pontoon boat comprising:

a first wing comprising a vertical portion and a horizontal portion and a curvature connecting said vertical and horizontal portions, such that said wing is substantially J-shaped;

a second wing comprising a vertical portion and a horizontal portion and a curvature connecting said vertical and horizontal portions, such that said wing is substantially J-shaped;

a first hydraulic mount attached to said vertical portion of said first wing, wherein said first hydraulic mount is configured to raise and lower said first wing relative to a water surface;

a second hydraulic mount attached to said vertical portion of said second wing, wherein said second hydraulic mount is configured to raise and lower said first wing relative to the water surface;

a first bracket connected to said first hydraulic mount for securing said first wing to a first pontoon of said pontoon boat; and a second bracket connected to said second hydraulic mount for securing said second wing to a second pontoon of said pontoon boat.

11. The hydrofoil wing system of claim 10, wherein said wings are constructed of aluminum.

12. The hydrofoil wing system of claim 10, wherein said wings are constructed of fiberglass.

13. The hydrofoil wing system of claim 10, wherein said wings are constructed of carbon fiber.

14. The hydrofoil wing system of claim 10, wherein said first hydraulic mount and said second hydraulic mount are configured to be operated via electromechanical switch from a helm of said pontoon boat.

15. A hydrofoil wing system for a pontoon boat having a first pontoon, a second pontoon, and a deck supported by said first pontoon and said second pontoon, said hydrofoil wing system comprising:

a first wing having a first terminal end and a second terminal end, the first terminal end of said first wing attached to the first pontoon and configured to rotate about a longitudinal axis at a point of attachment to said first pontoon;

a second wing having a first terminal end and a second terminal end, the first terminal end of said second wing attached to the second pontoon and configured to rotate about a longitudinal axis at a point of attachment to said second pontoon;

an adjustable mount attached to an underside of said deck, wherein said adjustable mount is configured to adjust the height relative to the underside of said deck of at least one of the second terminal end of said first wing and the second terminal end of said second wing;

wherein said adjustable mount is configured to be operated via an electromechanical switch from a helm of said pontoon boat.

16. The hydrofoil wing system of claim 15, wherein said adjustable mount is a first adjustable mount configured to adjust the height relative to the underside of said deck of the second terminal end of said first wing, and wherein said hydrofoil wing system further comprises:

a second adjustable mount attached to the underside of said deck, wherein said second adjustable mount is configured to adjust the height relative to the underside of said deck of the second terminal end of said second wing, wherein said second adjustable mount is configured to be operated via the electromechanical switch from the helm of said pontoon boat.

* * * * *